United States Patent [19]

Hoffmann et al.

[11] 4,215,625

[45] Aug. 5, 1980

[54] ADJUSTING ACTUATION OPERATED BY PRESSURE MEDIUM

[75] Inventors: Rüdiger Hoffmann, Sindelfingen; Dieter Feichtiger, Grafenau, both of Fed. Rep. of Germany

[73] Assignee: Daimler-Benz Aktiengesellschaft, Fed. Rep. of Germany

[21] Appl. No.: 831,143

[22] Filed: Sep. 7, 1977

[30] Foreign Application Priority Data

Sep. 9, 1976 [DE] Fed. Rep. of Germany ..... 2640561

[51] Int. Cl.[2] ..... F01B 19/00

[52] U.S. Cl. ..... 92/48; 91/189 R; 91/407; 92/6 D; 92/64; 92/65; 92/99; 92/100

[58] Field of Search ..... 92/6 D, 49, 64, 98 D, 92/99, 100, 101, 65, 48; 91/174, 25, 357, 408, 409, 189, 407

[56] References Cited

U.S. PATENT DOCUMENTS

| | | | |
|---|---|---|---|
| 2,465,714 | 3/1949 | Elliott | 92/49 |
| 2,936,785 | 5/1960 | Hastings | 92/49 |
| 3,145,659 | 8/1964 | Svendsen | 92/49 |
| 3,182,684 | 5/1965 | Hutchison | 92/48 |
| 3,187,640 | 6/1965 | Young | 92/65 |
| 3,381,582 | 5/1968 | Golden | 91/409 |
| 3,412,649 | 11/1968 | Franz | 92/64 |
| 3,824,903 | 7/1974 | Hahn | 92/64 |
| 3,923,427 | 12/1975 | Uyeda | 92/49 |

FOREIGN PATENT DOCUMENTS

| | | | |
|---|---|---|---|
| 2218082 | 10/1973 | Fed. Rep. of Germany | 92/100 |
| 2452748 | 5/1976 | Fed. Rep. of Germany | 92/99 |

*Primary Examiner*—Abraham Hershkovitz
*Attorney, Agent, or Firm*—Craig & Antonelli

[57] ABSTRACT

An adjusting drive operated by a pressure medium with a spring-loaded roller diaphragm secured to plates and displaceable within a housing by the pressure medium; the roller diaphragm actuates an adjusting member that is securely connected with a plate and extends out of the housing; in addition to its end positions, the adjusting member is also able to assume at least one intermediate position; the plates are thereby connected with each other by the roller diaphragm while a plate not directly connected with the adjusting member sealingly rests on a ring-shaped abutment projecting out of the inner wall of the housing in the intermediate position of the adjusting member.

21 Claims, 2 Drawing Figures

ADJUSTING ACTUATION OPERATED BY PRESSURE MEDIUM

Figure 1:
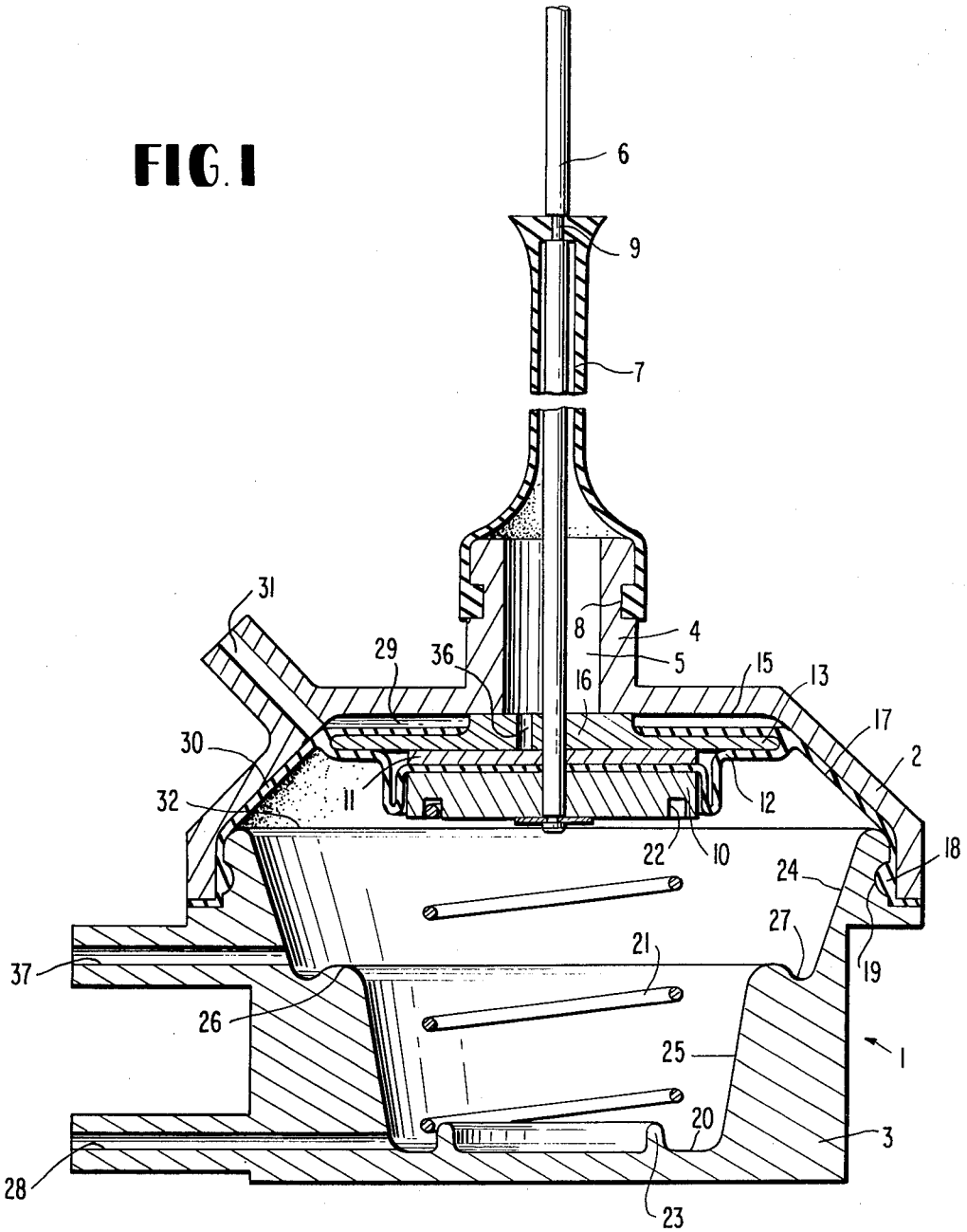

The present invention relates to an adjusting drive or actuation operated by a pressure medium with spring-loaded roller diaphragms secured at plates and displaceable in a housing by pressure medium, which actuate an adjusting member extended out of the housing and rigidly secured with a plate, which adjusting member is able to assume, in addition to end positions, at least one intermediate position.

Such an adjusting drive or actuation is disclosed in the German Offenlegungsschrift 2,158,786 published on 5/30/73. It involves a two-stage vacuum-adjusting drive or actuation with telescopic-like displacement possibility of two adjustment actuating steps relative to one another, which is to achieve a largest possible effective stroke with a small space requirement and with a simple manufacture and installation. The prior art adjusting drive, however, entails the disadvantage that two connections are required for vacuum, of which at least one has to be constructed movable, and in that the housing of the two drive or actuating steps are arranged displaceable relative to one another, from which result difficulties as regards assembly, guidance and sealing.

The present invention is concerned with the task to provide an adjusting drive or actuation of the aforementioned type which compared to the prior art adjusting drive or actuation is constructed considerably more simply, especially as regards the number and type of its movable parts.

The underlying problems are solved according to the present invention in that the plates are connected with each other exclusively by a roller diaphragm and in that in the intermediate position a plate not directly connected with the adjusting member rests sealingly on a ring-shaped abutment projecting out of the inner wall of the housing.

In the adjusting drive or actuation according to the present invention, it is achieved in a simple manner that the adjusting member is able to assume one or several intermediate positions. Of movable parts, only the plates and the roller diaphragms connected therewith are present in addition to the adjusting member. The housing does not carry out any movement and can thus be manufactured and sealed in a simple manner. The number of intermediate positions can be chosen at will and is dependent exclusively on the number of plates, on the roller diaphragms connected therewith and on the abutments.

Accordingly, it is an object of the present invention to provide a pressure medium operated adjusting drive which avoids by simple means the aforementioned shortcomings and drawbacks encountered in the prior art.

Another object of the invention resides in an adjusting actuation operated by pressure medium which reduces the number of vacuum connections and simplifies the assembly, guidance and sealing of the various parts.

A further object of the present invention resides in a pressure medium operated adjusting drive in which the housing can be constructed considerably more simply by eliminating the need for parts that are movable relative to one another.

Still another object of the present invention resides in a pressure medium operated adjusting actuation which reduces the number of movable parts and which also simplifies the construction thereof.

Another object of the present invention resides in an adjusting actuation of the type described above, by means of which one or several intermediate positions can be obtained by extremely simple means.

Figure 2:
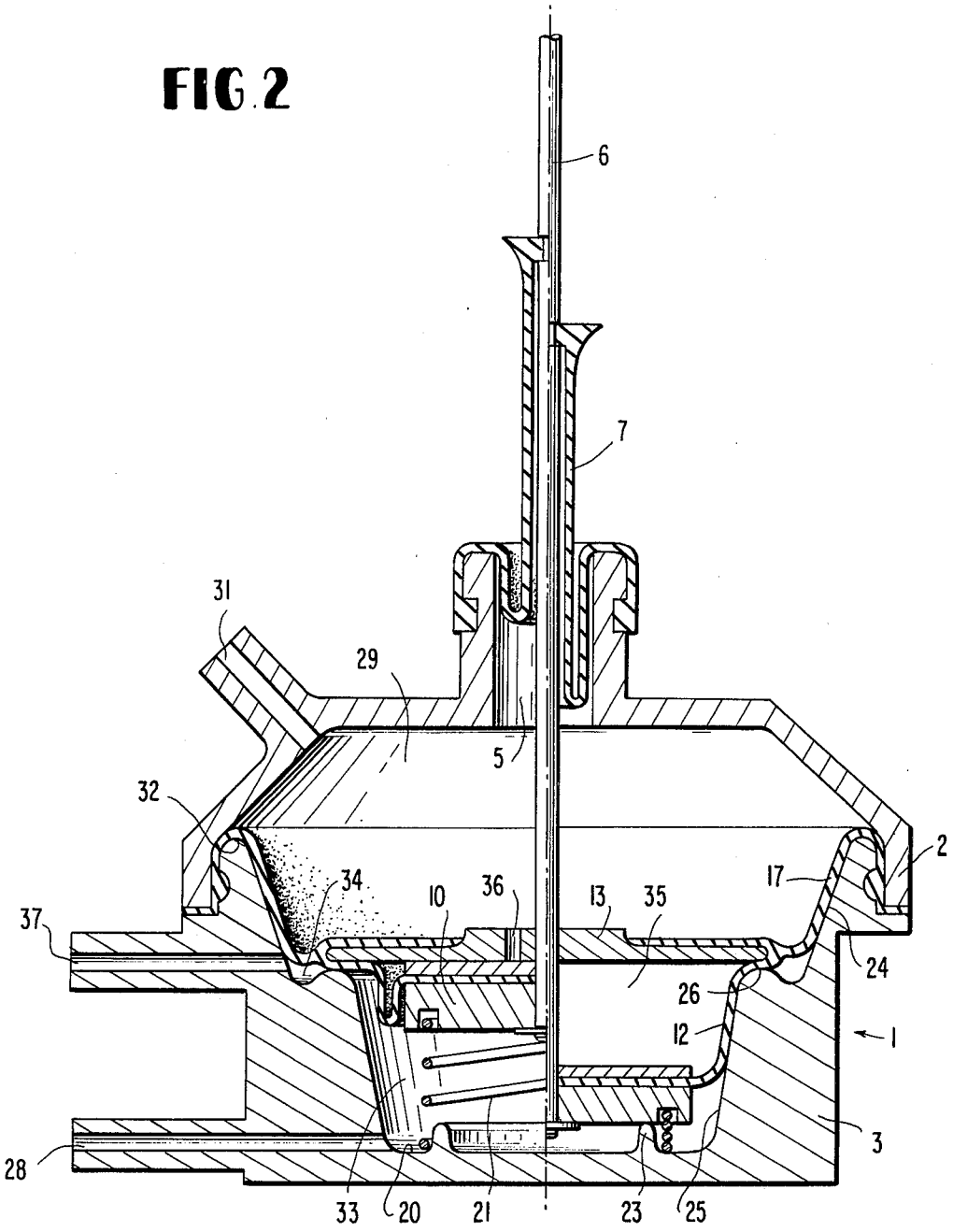

These and other objects, features and advantages of the present invention will become more apparent from the following description when taken in connection with the accompanying drawing which shows, for purposes of illustration only, one embodiment in accordance with the present invention, and wherein:

FIG. 1 is a cross-sectional view through an adjusting actuation according to the present invention with an adjusting member in its upper end position; and FIG. 2 is a cross-sectional view through the adjusting actuation of FIG. 1, illustrating in the left half of the drawing the adjusting member in an intermediate position and in the right half of the drawing the adjusting member in a lower end position.

Referring now to the drawing wherein like reference numerals are used throughout the various views to designate like parts, the essentially cylindrically shaped housing generally designated by reference numeral 1 of the adjusting drive or actuation consists of an upper housing half 2 and of a lower housing half 3 which are securely and sealingly connected with each other by conventional means. A stub 4 with a wide opening 5 is provided on the upper housing half 2, through which an adjusting member 6 constructed as rod is extended toward the outside. The opening 5 is sealed against the outside by a sleeve 7 which is secured externally at the stub 4 and at the adjusting member 6 in recesses 8 and 9, respectively. The width of the opening 5 permits a good rolling-off of the sleeve 7 during a downward movement of the adjusting member 6, as can be recognized in FIG. 2.

The adjusting member 6 is securely connected at its lower end in the interior of the housing 1 with a plate 10 and an auxiliary plate 11, whereby the radially inner portion of a roller diaphragm 12 is clamped in between the plates 10 and 11. The adjusting member 6 extends guidingly but without fixed connection through a second plate 13 above the auxiliary plate 11. The roller diaphragm 12 is drawn about the outer edge of the plate 13 and is secured on its upper surface in the outer area. A projection 16 of the plate 13 which projects against the ceiling 15 of the upper housing half 2, prevents a pressing-on and therewith a possible adhesion of the roller diaphragm 12 at the ceiling 15. A second roller diaphragm 17 extends from the first roller diaphragm 12 within the area of the outer edge of the plate 13 and secured in the lower housing half 2 by means of a bead 18 in a recess 19, is clamped-in radially outwardly thereof between the upper housing half 2 and the lower housing half 3. The second roller diaphragm 17 serves simultaneously as seal of the two housing halves 2 and 3. The first and second roller diaphragms 12 and 17 may be made in one piece with several branches, of which one is secured at the housing 1 and another branch is secured at each plate 10 and 13, as described above. A coil compression spring 21 is clamped-in between the plate 10 and the bottom 20 of the lower housing half 3, which, on the one hand, is guided in a recess 22 provided in the plate 10 and, on the other, is guided by a ring-shaped raised portion 23 on the bottom 20, which serves simultaneously as lower abutment for the plate 10.

The inner wall of the lower housing half 3 is formed essentially by an upper and a lower conical surface 24 and 25 which are separated from one another by a ring-shaped abutment 26 projecting out of the inner wall. The abutment 26 further includes an undercut 27. The abutment 26 is rounded-off, as also the transitions from the abutment 26 to the lower conical surface 25 and to the undercut 27 and from the latter to the upper surface 24, whereby in connection with the conical surfaces 24 and 25, a completely satisfactory rolling-off of the roller diaphragms 12 and 17 is assured. The diameter of the abutment 26 is slightly smaller than the diameter of the plate 13 so that the plate 13 rests on the abutment 26 during a downward movement under interposition of the roller diaphragm 12, which assures a good seal (FIG. 2, left half). The plate 10 has a smaller diameter than the conical surface 25 with its smallest diameter so that a downward movement of the plate 10 to the raised portion 23 cannot be prevented by the conical surface 25.

A single connection 28 for vacuum suffices in principle for the actuation of the adjusting drive, which connection terminates in or directly above the bottom 20 in the interior of the housing 1, when the chamber 29 between the plate 13 and the roller diaphragm 17 as well as the inner wall 30 of the upper housing half 2 is in communication with the atmosphere, for example, by way of the opening 31. In order to displace the adjusting member 6 from the upper end position illustrated in FIG. 1, into the intermediate position of FIG. 2, illustrated in the left half of this figure, a predetermined vacuum is produced in the interior of the housing 1 by way of the connection 28 which displaces the roller diaphragms 12 and 17 together with the plates 10 and 13 as well as with the adjusting member 6 against the force of the spring 21 in the downward direction until the plate 13 rests with the roller diaphragm 12 on the abutment 26, whereby the roller diaphragm 17 abuts at the conical surface 24 (FIG. 2, left half of drawing). The vacuum must thereby be so determined that the force of the spring 21 in the intermediate position, on the one hand, is smaller than the force exerted by the vacuum on the circular surface determined by the upper edge 32 of the lower housing half 3 and, on the other, is larger than the force exerted by the vacuum on the circular surface determined by the abutment 26. Since the first circular surface in the described embodiment is larger in every case than the second circular surface, a stable intermediate position is attained.

In order to displace the adjusting member 6 into the lower end position, illustrated in FIG. 2 in the right drawing half, the vacuum in the chamber 33 underneath the roller diaphragm 12 (FIG. 2) is further increased by way of the connection 28 until the force of the spring 21 is smaller than the force exerted by the vacuum on the circular surface determined by the abutment 26. The plate 10 then snaps together with the adjusting member 6 into the lower end position up to abutment at the raised portion 23, whereby the roller diaphragm 12 abuts at the lower conical surface 25. The plate 13 thereby continues to rest on the abutment 26 since the lower vacuum prevails in the chamber 34 between the roller diaphragm 12 and the upper conical surface 24. The space 35 between the two plates 10 and 13 is thereby vented by way of an opening 36 in the plate 13.

If the adjusting member 6 is to be displaced from the lower end position into the intermediate position, the vacuum determinative for the intermediate position is adjusted in the chamber 33 by way of the connection 28 so that the spring 21 forces the plate 10 together with the adjusting member 6 up to the abutment at the plate 13. With a venting of the chamber 33 by way of the connection 28, the spring 21 forces the plates 10 and 13 as well as the roller diaphragms 12 and 17 together with the adjusting member 6 into the upper end position illustrated in FIG. 1. This operation can be accelerated in that a vacuum is produced in the chamber 29 by way of the opening 31.

A further improvement results if a further connection 37 for vacuum terminates in the interior space in the upper conical surface 24 directly above the undercut 27. The vacuum in the chamber 34 can be produced and maintained by way of this connection 37 so that only the larger vacuum has to be produced in the chamber 33 by way of the connection 28. During a return of the adjusting member 6 in the upper end position, the chamber 34 may additionally be vented by way of this connection 37.

While we have shown and described only one embodiment in accordance with the present invention, it is understood that the same is not limited thereto but is susceptible of numerous changes and modifications as known to those skilled in the art, and we therefore do not wish to be limited to the details shown and described herein but intend to cover all such changes and modifications as are encompassed by the scope of the appended claims.

We claim:

1. A pressure-medium operated adjusting drive, comprising a housing means, a first roller diaphragm means displaceable in said housing means by a pressure medium and operatively connected with a plurality of individual plate means, an adjusting member securely connected with a first of the plurality of individual plate means and extending out of the housing means, said adjusting member being actuated in an adjusting direction by said first roller diaphragm means, said adjusting member having two end positions and at least one intermediate position, characterized in that a second roller diaphragm means is provided for respectively connecting each of the plurality of plate means to each other, a second of said plurality of plate means is nondirectly connected with the adjusting member, an abutment means projects out of an inner wall of the housing means, in the intermediate position the nondirectly connected plate means sealingly rests on the abutment means, and in that the abutment means is rounded-off and includes an undercut, and characterized in that a seal between the second plate means and the abutment means results when said second plate means sealingly rests on the abutment means, said seal is formed by the first roller diaphragm means.

2. An adjusting drive according to claim 1, characterized in that the first and second roller diaphragm means are made in one piece and include several branches, one of said several branches is secured at the housing means and another of said several branches is secured at each of the plurality of plate means.

3. An adjusting drive according to claim 2, characterized in that an inner surface of the housing means is constructed conically on both sides of the abutment means as viewed in the adjusting direction of the adjusting member.

4. An adjusting drive according to claim 3, characterized in that the inner surface of the housing means tapers in the adjusting direction of the adjusting member so that in a first of the two end positions the first roller diaphragm means abuts at the conical surface on one side of the abutment means while the second roller diaphragm means abuts at the conical surface on the other side of abutment means.

5. An adjusting drive according to claim 4, characterized in that a first vacuum connection means is provided for supplying a vacuum to an interior of the housing means, the first vacuum connection means being disposed within an area in which the first plate means is located when the first and second roller diaphragm means are abutting at the conical surfaces.

6. An adjusting drive according to claim 5, characterized in that a second vacuum connection means is provided for supplying a vacuum to the interior of the housing means, said second vacuum connection means being substantially directly adjacent the abutment means whereby the first and second vacuum connection means are located on opposite sides of the abutment means in the adjusting direction.

7. An adjusting drive according to claim 6, characterized in that a third vacuum connection means is provided for supplying a vacuum to the interior of the housing means, said third vacuum connection means is separated from the first and second vacuum connection means by the first roller diaphragm means, and in that the first roller diaphragm means is secured to the housing means.

8. An adjusting drive according to claim 7, characterized in that the abutment means is ring-shaped.

9. An adjusting drive according to claim 8, characterized in that means are provided for spring-loading the first and second roller diaphragm means.

10. A pressure-medium adjusting drive, comprising a housing means, a first roller diaphragm means displaceable in said housing means by a pressure-medium and operatively connected with a plurality of individual plate means, an adjusting member securely connected with a first of said plate means and extending out of the housing means, said adjusting member being actuated in an adjusting direction by said first roller diaphragm means and having in addition to end positions, at least one intermediate position, characterized in that the plate means are respectively connected with each other by a second roller diaphragm means, in that in the intermediate position a second plate means non-directly connected with the adjusting member sealingly rests on an abutment means projecting out of the inner wall of the housing means, and in that an inner surface of the housing means is constructed conically on both sides of the abutment means so that in a first of the end positions the first roller diaphragm means abuts at the conical surface on one side of the abutment means while the second roller diaphragm means abuts at the conical surface on the other side of the abutment means.

11. An adjusting drive according to claim 10, characterized in that the abutment means is ring-shaped.

12. An adjusting drive according to claim 11, characterized in that means are provided for spring-loading the first and second roller diaphragm means.

13. An adjusting drive according to claim 10, characterized in that the first and second roller diaphragm means are made in one piece and include several branches, one of said several branches is secured at the housing means and another of said several branches is secured at each of the plurality of plate means.

14. An adjusting drive according to claim 10, characterized in that a first vacuum connection means is provided for supplying a vacuum to an interior of the housing means, said first vacuum connection means being disposed within an area in which the first plate means is located when the adjusting member is in one of the end positions.

15. An adjusting drive according to claim 14, characterized in that a second vacuum connection means is provided for supplying a vacuum to the interior of the housing means, said second vacuum connection means being substantially directly adjacent the abutment means whereby the first and second vacuum connection means are located on opposite sides of the abutment means as viewed in the adjusting direction of the adjusting member.

16. An adjusting drive according to claim 15, characterized in that a third vacuum connection means is provided for supplying a vacuum to the interior of the housing means, said third vacuum connection means is separated from the first and second vacuum connection means by the first roller diaphragm means, and in that the first roller diaphragm means is secured to the housing means.

17. An adjusting drive according to claim 10, characterized in that a third plate means is provided and arranged between the first and second plate means for clamping a radially inner portion of the second roller diaphragm means.

18. A pressure-medium adjusting drive, comprising a housing means, a first roller diaphragm means displaceable in said housing means by a pressure-medium and operatively connected with a plurality of individual plate means, an adjusting member securely connected with a first of said plate means and extending out of the housing means, said adjusting member being actuated in an adjusting direction by said first roller diaphragm means and having in addition to end positions, at least one intermediate position, characterized in that the plate means are respectively connected with each other by a second roller diaphragm means, in that in the intermediate position a second plate means non-directly connected with the adjusting member sealingly rests on an abutment means projecting out of the inner wall of the housing means, and in that an inner surface of the housing means is constructed conically on both sides of the abutment means, and characterized in that the inner surface of the housing means tapers in the adjusting direction of the adjusting member so that in a first of the end positions the first roller diaphragm means abuts at the conical surface on one side of the abutment means while the second roller diaphragm means abuts at the conical surface on the other side of abutment means.

19. A pressure-medium operated adjusting drive, comprising a housing means, a first roller diaphragm means displaceable in said housing means by a pressure medium and operatively connected with a plurality of individual plate means, an adjusting member securely connected with a first of the plurality of individual plate means and extending out of the housing means, said adjusting member being actuated in an adjusting direction by said first roller diaphragm means, said adjusting member having two end positions and at least one intermediate position, characterized in that a second roller diaphragm means is provided for respectively connecting each of the plurality of plate means to each other, a second of said plurality of plate means is non-directly connected with the adjusting member, an abutment means projects out of an inner wall of the housing means, in the intermediate position the non-directly connected plate means sealingly rests on the abutment means, and in that the abutment means is rounded-off and includes an undercut, characterized in that a third plate means is provided and arranged between the first and second plate means for clamping a radially inner portion of the second roller diaphragm means, characterized in that an inner surface of the housing means is constructed conically on both sides of the abutment means as viewed in the adjusting direction of the adjusting member, and characterized in that the inner surface of the housing means tapers in the adjusting direction of the adjusting member so that in a first of the end positions, the first roller diaphragm means abuts at the conical surface on one side of the abutment means while the second roller diaphragm means abuts at the conical surface on the other side of the abutment means.

20. An adjusting drive according to claim 19, characterized in that the housing means includes a further conical surface, and in that the first roller diaphragm means is in abutment with the further conical surface when the adjusting member is in the other of the two end positions.

21. A pressure-medium adjusting drive, comprising a housing means, a first roller diaphragm means displaceable in said housing means by a pressure means and operatively connected with a plurality of individual plate means, an adjusting member securely connected with a first of the plate means and extending out of the housing means, said adjusting member being actuated in an adjusting direction by said first roller diaphragm means, said adjusting member having two end positions and at least one intermediate position, characterized in that a second roller diaphragm means is provided for operatively connecting the plurality of plate means to each other, a second plate means is non-directly connected to the adjusting member so as to be moveable relative thereto, a third plate means is connected to the adjusting member and is arranged between the first and second plate means for clamping a radially inner portion of said second roller diaphragm means, said first roller diaphragm means is clamped to the housing means and is connected to the second roller diaphragm means such that said first, second, and third plate means and said first and second roller diaphragm means along with the adjusting member move as a unit between a first end position and said at least one intermediate position, an abutment means projects out of an inner wall of the housing means for limiting a displacement of said second plate means, the second plate means is adapted to sealingly rest on the abutment means when the adjusting member is in the intermediate position, an inner surface of the housing means is constructed conically on both sides of the abutment means as viewed in an adjusting direction of the adjusting member, a first vacuum connection means is provided for supplying a vacuum to an interior of the housing means, the first vacuum connection means being disposed in an area in which the first plate means is located when the first and second roller diaphragm means are abuting the conical surfaces, a second vacuum connection means is provided for supplying a vacuum to the interior of the housing means, said second vacuum connection means being substantially directly adjacent the abutment means, a third vacuum connection means is provided for supplying a vacuum to the interior of the housing means, said third vacuum connection means is separated from the first and second vacuum connection means by the first roller diaphragm means, such that the three plate means, adjusting member, and first and second roller diaphragm means move from said first end position to the intermediate position when the first vacuum connection is connected to a vacuum source at a first vacuum level and the second plate means and second roller diaphragm means remain in contact with the abutment means while the first plate means and third plate means, the second roller diaphragm means and the adjusting member move to the second end position when the first vacuum connection is connected to a vacuum source at a second higher vacuum level.

* * * * *